US009931000B1

(12) United States Patent
Calderon

(10) Patent No.: US 9,931,000 B1
(45) Date of Patent: Apr. 3, 2018

(54) TOOTHBRUSH AND TOOTHPASTE HOLDER

(71) Applicant: Ambrose H. Calderon, Queens, NY (US)

(72) Inventor: Ambrose H. Calderon, Queens, NY (US)

( * ) Notice: Subject to any disclaimer, the term of this patent is extended or adjusted under 35 U.S.C. 154(b) by 360 days.

(21) Appl. No.: 14/817,726

(22) Filed: Aug. 4, 2015

(51) Int. Cl.
*A47K 1/09* (2006.01)
*A47B 67/02* (2006.01)
*A47B 81/02* (2006.01)
*A46B 17/06* (2006.01)

(52) U.S. Cl.
CPC ..... *A47K 1/09* (2013.01); *A46B 17/065* (2013.01); *A47B 67/02* (2013.01); *A47B 81/02* (2013.01)

(58) Field of Classification Search
CPC ..... A45D 44/18; A47B 81/02; A47L 2/10; B65D 69/00; G07F 11/62; A46B 17/06; A46B 17/065; A47K 1/09
USPC ..... 132/308, 310; 211/65, 66; 312/206, 312/207; 206/362.1, 63.5, 362.3, 368, 206/362; 220/211, 263, 262, 507; 221/92
See application file for complete search history.

(56) References Cited

U.S. PATENT DOCUMENTS 1,361,842 A * 12/1920 Evslin ..... A47K 1/09 132/308
1,584,261 A * 5/1926 Vuolo ..... A45D 44/18 132/308
1,992,564 A * 2/1935 Amdur ..... A47K 1/09 132/310
2,564,353 A * 8/1951 Coleman ..... A47K 1/09 312/206
3,020,941 A 2/1962 Corley
3,155,278 A 11/1964 LeBaron
3,241,721 A 3/1966 Freeman
3,954,407 A * 5/1976 Andary ..... A61L 2/10 250/455.11
4,258,864 A 3/1981 Karamanolis
4,986,759 A * 1/1991 Duncan ..... A47K 1/09 211/66
4,995,511 A 2/1991 Evans
5,095,924 A * 3/1992 Stanfield ..... A45D 27/22 132/310
5,215,193 A * 6/1993 Dennis ..... A47K 5/18 132/309
6,719,169 B1 4/2004 Gandy
7,401,699 B1 7/2008 Griffin, Jr.
2011/0100865 A1* 5/2011 Brink ..... A61C 19/02 206/581
2013/0112713 A1* 5/2013 Ellis ..... A47K 5/18 222/181.3

FOREIGN PATENT DOCUMENTS

GB 684630 12/1934

* cited by examiner

*Primary Examiner* — Tatiana Nobrega

(57) ABSTRACT

The toothbrush and toothpaste holder is a storage device intended for use with toothbrushes and toothpaste. The toothbrush and toothpaste holder comprise a plurality of toothbrush storage compartments and a toothpaste storage compartment. Each of the toothbrush storage compartments is fitted with an ultraviolet light for sanitation.

9 Claims, 3 Drawing Sheets

TOOTHBRUSH AND TOOTHPASTE HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of cabinetry and containers, more specifically, a container configured for use in storing toothbrushes.

SUMMARY OF INVENTION

The toothbrush and toothpaste holder is a storage device intended for use with toothbrushes and toothpaste. The toothbrush and toothpaste holder comprises a plurality of toothbrush storage compartments and a toothpaste storage compartment. Each of the toothbrush storage compartments is fitted with an ultraviolet light for sanitation.

These together with additional objects, features and advantages of the toothbrush and toothpaste holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the toothbrush and toothpaste holder in detail, it is to be understood that the toothbrush and toothpaste holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toothbrush and toothpaste holder.

It is therefore important that the claims be regarded as including such equivalent construction insofar as they do not depart from the spirit and scope of the toothbrush and toothpaste holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
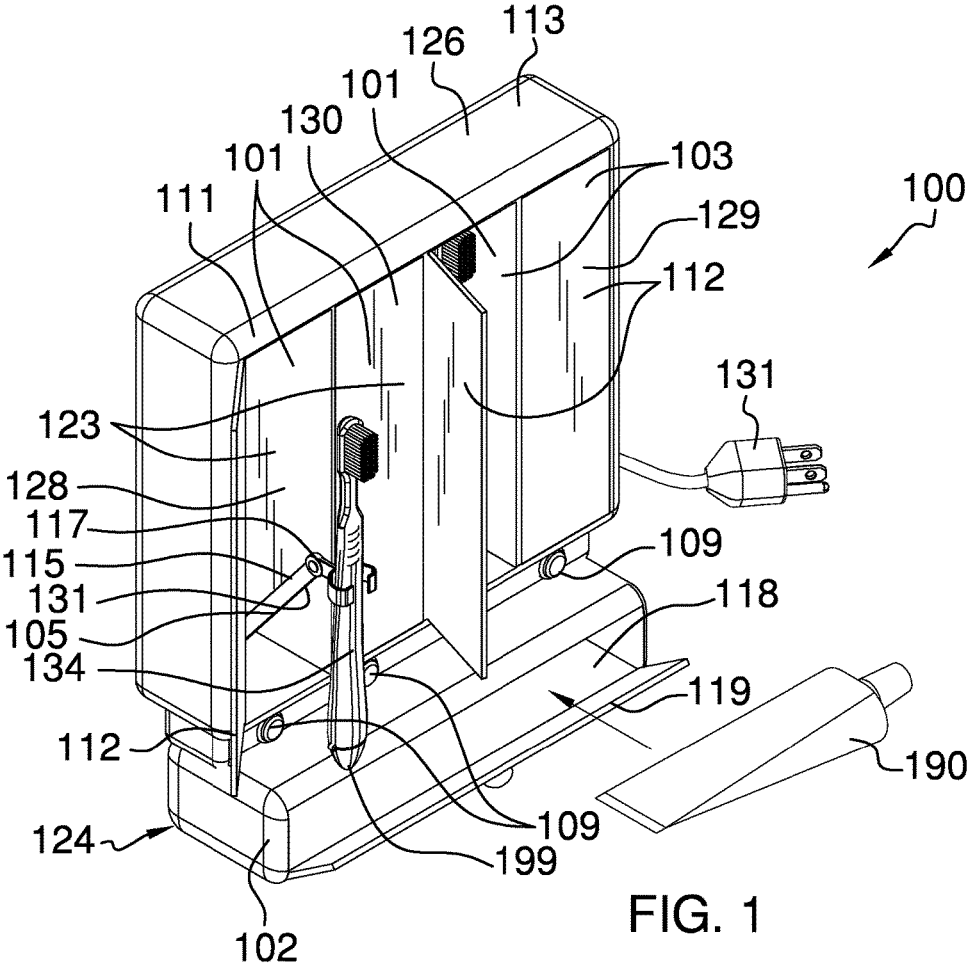
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As illustrated in FIGS. 1 through 5, the toothbrush and toothpaste holder 100 (hereinafter invention) comprises a housing 113, a front panel 111, a plurality of toothbrush storage compartments 101 and a toothpaste storage compartment 102 and a power cord 131.

In the specification and claims, the following directional references will be used:

For purposes of directional reference, the toothbrush and toothpaste holder can essentially be viewed as a six-sided container. A front face 123 of the six-sided container is fitted access doors to the interior of the six sided container. A back face 122 of the six-sided container is the face distal from the front face 123 of the six-sided container. A bottom side 124 of the six-sided container is one of the long sides of the toothpaste storage compartment. When facing the front face 123 of the toothbrush and toothpaste holder in clockwise order starting from the bottom side 124 the remaining sides are called a left side 125, a top side 126, and a right side 127. The horizontal direction travels back and forth from the left side 125 to the right side 127. The vertical direction travels back and forth from the top side 126 to the bottom side 124. The depth direction travels back and forth from the front face 123 to the back face 122. In a final directional reference, when two objects are being compared, each object takes the name of the side it is closest to. For example, when two objects are compared, the object closest to the left side 125 will be referred to as to the leftmost or the object to the left.

The housing 113 is a five-sided container in the shape of the rectangular block that forms the back face 122, top side 126, right side 127 bottom side 124 and left side 125 of the invention 100. The back face 122 of the housing 113 is formed with a first mounting hole 120 and a second mounting hole 121 that can be used to mount the housing 113 to a wall. The front face 123 of the housing 113 is open to allow access into the interior of the housing 113.

The front panel 111 is mounted on the housing 113 to provide the front face 123 of the invention 100. The front panel 111 is a panel with holes formed in it to allow access into the interior of the housing 113 and to the plurality of open close switches 109. Each toothbrush storage compartment 101 comprises a vertical chamber 103, a vertically hinged door 112, an arm 105, a motor 107, a linkage 108, an open close switch 109, an ultraviolet light 110, and wiring.

The vertical chamber 103 is a space bounded by the back face 122 and top side 126. The leftmost vertical chamber 128 is also bounded by the left side 125 of the housing 113 and the rightmost vertical chamber 129 is bounded by the right side 127 of the housing. The bottommost side of each vertical chamber 103 is bounded by the topmost side of the toothpaste storage compartment 102. Internal vertical dividers 130 are dividers that run vertically within the housing 113 separate each vertical chamber 103 internally from each other and a vertically hinged door 112 is mounted to the front panel 111 to act as the front face 123 of each vertical chamber 103.

The purpose of the arm 105 is to hold the toothbrush 134 securely while stored in the invention 100. The arm 105 comprises a shaft 115, a first pivot point device 116, a toothbrush holder 106, and a second pivot point device 117. The shaft 115 is a bar with a first end 132 and a second end 133. The first pivot point device 116 is mounted to the first end 132 of the shaft 115. The second pivot point device 117 is mounted to the second end 133 of the shaft 115.

A toothbrush holder 106 is attached to the second pivot point device 117. The toothbrush holder 106 has a ring shape that is adapted to grip a non-brush end 199 of the toothbrush 134. Moreover, the non-brush end 199 of the toothbrush 134 is adapted to be inserted into the toothbrush holder 106. The toothbrush holder 106 is selected so that an inner diameter 197 of the toothbrush holder 106 is smaller than a toothbrush outer diameter 198 of the toothbrush 134.

The second pivot point device 117 enables the toothbrush holder 106 to rotate around a second pivot point 195. When the arm 105 is moved, the force of gravity rotates the toothbrush holder 106 around the second pivot point 195 keeping the toothbrush 134 vertically positioned.

The first pivot point device 116 is a hinge that is used to rotate the shaft 115 around a first pivot point 195 into and out of the invention 100, and with respect to a depth 194. The purpose of the first pivot point device 116 is to move the toothbrush 134 out of and back into the invention 100.

The first pivot point device 116 is attached to a linkage 108 that connects the first pivot point device 116 to a motor 107. The motor 107 is an electric motor. When the motor 107 is turned on the rotational motion of the motor 107 is transferred through the linkage 108 to the first pivot point device 116, which rotates the arm 105.

The motor 107 is controlled by an open close switch 109 that can be mounted in the front panel 111 or the vertically hinged door 112. The invention 100 is wired so that when the open close switch 109 is pushed the motor 107 is activated so that the arm 105 rotates towards the back face 122 when initially extended outside of the invention 100 and so that the arm 105 rotates towards the front face 123 when the arm 105 is initially retracted inside the invention 100. When extending the arm 105, the motor 107 will push the vertically hinged door 112 open if it is closed. The user closes the vertically hinged door 112 after the motor 107 retracts the arm 105.

Each vertical chamber 103 is fitted with an ultraviolet light 110 that is adapted to be used to sanitize the toothbrush 134 while in storage. The ultraviolet light 110 can remain continuously on while power is applied to the invention 100 or a switch can be wired to the vertically hinged door 112 to turn off the ultraviolet light 110 while the door is open. A power cord 131 is provided with the invention 100 to provide a source of external electrical power for the motors 107 and ultraviolet lights 110.

The toothpaste storage compartment 102 comprises a horizontal chamber 118 and a horizontally hinged door 119. The horizontal chamber 118 is bounded by the back face 122, the bottom side 124, left side 125, right side 127 and an internal horizontal divider 135. The internal horizontal divider 135 is a divider formed within the housing 113 that runs horizontally across the invention 100. A horizontally hinged door 119 is mounted to the front panel 111 and acts as the front face 123 of the horizontal chamber 118.

To use the invention 100, the user pushes the open close switch 109. This activates the motor 107, which rotates the arm 105 to extend the toothbrush 134. Once finished, the user places the toothbrush 134 in the toothbrush holder 106 and pushes the open close switch 109, which rotates the arm 105 to retract the toothbrush 134. The user then closes the vertically hinged door 112. To access toothpaste 190, the user opens the horizontally hinged door 119 and removes the toothpaste 190. When finished, the user places the toothpaste 190 in the toothpaste storage compartment 102 and closes the horizontally hinged door 119. It shall be noted that the term toothpaste 190 is being used to refer to a container of toothpaste, which may involve a tube or other structure that dispenses toothpaste there from.

The housing 113, front panel 111, each vertically hinged door 112, each shaft 115, and the horizontally hinged door 119 can each be formed from molded plastic. Suitable plastics include, but are not limited to, polyethylene or polycarbonate. The motors 107, ultraviolet lights 110, open close switches 109, first pivot point device 116, second pivot point device 117, linkage 108, and toothbrush holder 106 are commercially available.

The design, installation, wiring, operation and control of electric motors and linkages are well known and documented in the art. The installation, wiring and operation of ultraviolet light sources are well known and documented in the art.

Detailed reference will now be made to a first potential embodiment of the disclosure, which is illustrated in FIGS. 1 through 5.

Figure 2:
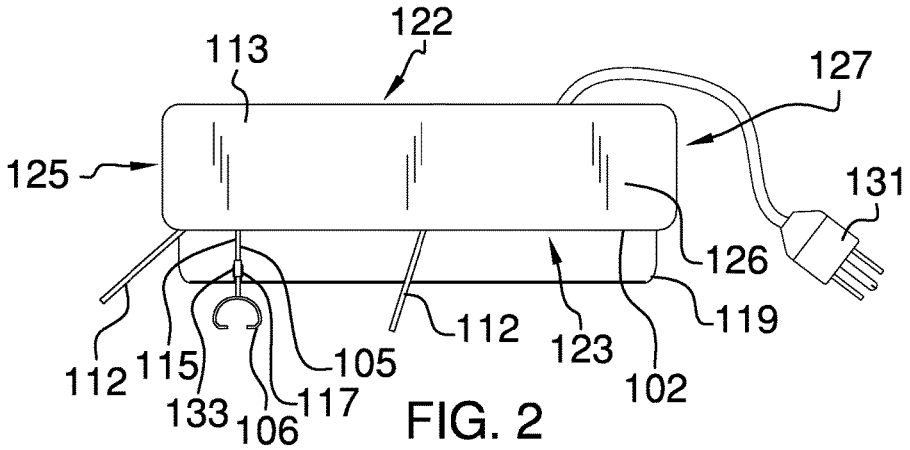
FIG. 2 is a top view of an embodiment of the disclosure.
Figure 3:
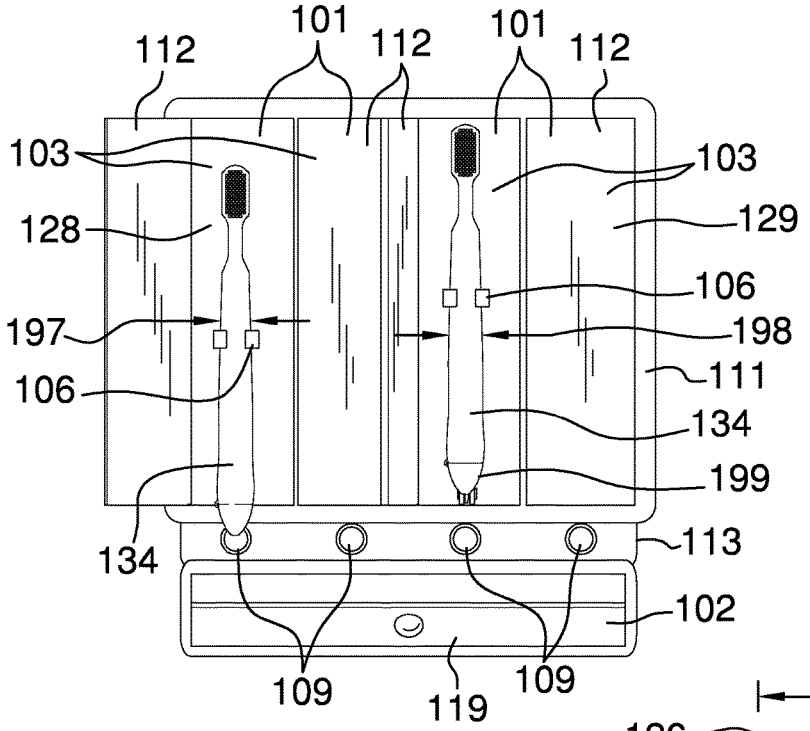
FIG. 3 is a front view of an embodiment of the disclosure.
Figure 4:
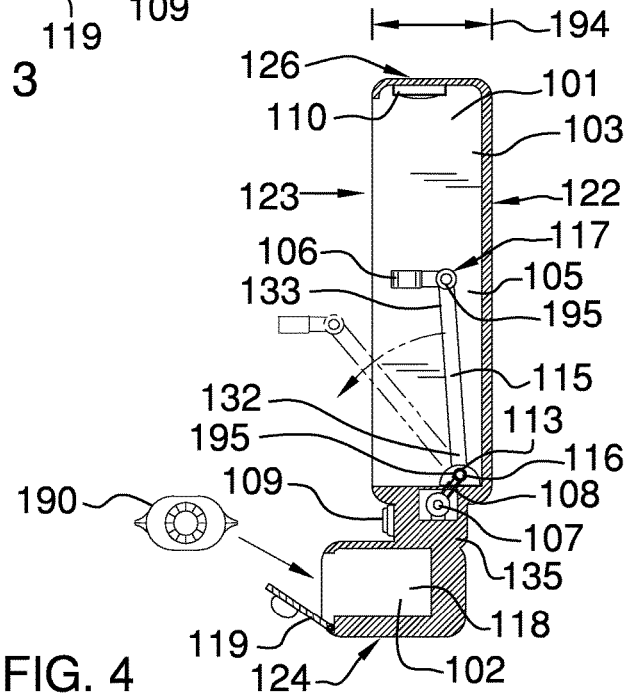
FIG. 4 is a side view of an embodiment of the disclosure.
Figure 5:
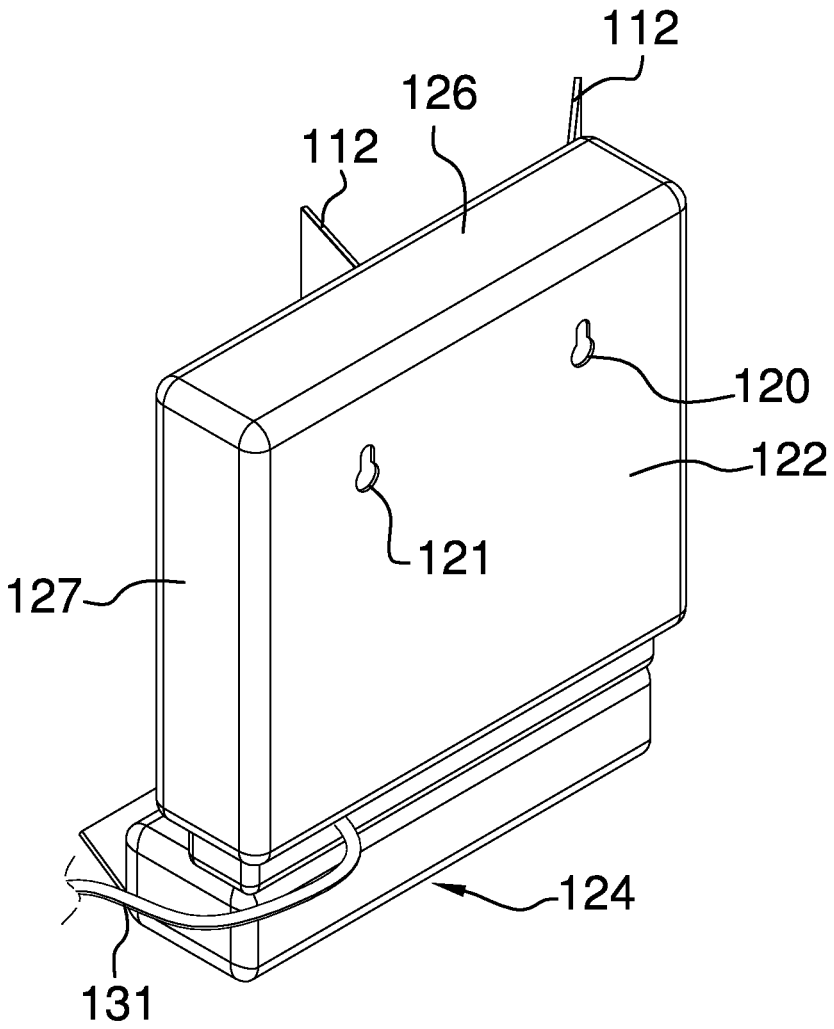
FIG. 5 is a rear perspective view of an embodiment of the disclosure.

FIG. 1 shows a perspective view of the invention 100 with four toothbrush storage compartments 101. The leftmost vertical chamber 128 shows the arm 105 extended while the toothbrush storage compartment to the immediate left of the rightmost vertical chamber 129 shows the arm 105 retracted. FIG. 2 shows the best view of the toothbrush holder 106. FIG. 3 shows the best view of the open close switches 109. FIG. 4 is a cross-sectional view that shows the motor 107, linkage 108, first pivot point device 116, second pivot point device, 117 and ultraviolet light 110. FIG. 5 shows a rear perspective view of the invention 100 including the first mounting hole 120 and second mounting hole 121.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A toothbrush and toothpaste holder comprising:

a housing;

a front panel;

a plurality of toothbrush storage compartments, which are each adapted to store a toothbrush when not in use; a toothpaste storage compartment, which is adapted to store toothpaste;

wherein each toothbrush storage compartment comprises a vertical chamber, a vertically hinged door, an arm, a motor, a linkage coupling the arm to the motor for actuating the arm, an open close switch for controlling the motor, and a ultraviolet light;

wherein the toothpaste storage compartment comprises a horizontal chamber and a horizontally hinged door;

wherein the housing is further defined with a back face, a top side, a right side, a bottom side, and a left side forming the plurality of toothbrush storage compartments as well as the toothpaste storage compartment;

wherein the front panel is mounted on the housing and circumscribes the vertically hinged doors to provide a front face of the plurality of toothbrush storage compartments as well as the toothpaste storage compartment.

2. The toothbrush and toothpaste holder according to claim 1 wherein the front panel has holes formed in it which accommodate the vertically hinged doors to allow access into an interior of the housing.

3. The toothbrush and toothpaste holder according to claim 2 wherein each of the arms adaptively holds a toothbrush securely while stored inside the plurality of toothbrush storage compartments; wherein each of the arms comprises a shaft, a first pivot point device, a toothbrush holder and a second pivot point device; wherein the shaft is further defined with a first end and a second end; wherein the first pivot point device is mounted to the first end of the shaft and is coupled to the linkage; wherein the second pivot point device is mounted to the second end of the shaft and is coupled to the toothbrush holder.

4. The toothbrush and toothpaste holder according to claim 3 wherein the first pivot point device rotates the shaft into and out of the plurality of toothbrush storage compartments with respect to a depth of the housing.

5. The toothbrush and toothpaste holder according to claim 4 wherein the open close switch is wired so that when pushed, the motor is activated so that the arm rotates towards the back face.

6. The toothbrush and toothpaste holder according to claim 5 wherein the ultraviolet lights are capable of sanitizing toothbrushes stored in the plurality of toothbrush storage compartments.

7. The toothbrush and toothpaste holder according to claim 1 wherein each of the arms adaptively holds a toothbrush securely while stored inside the plurality of toothbrush storage compartments; wherein each of the arms comprises a shaft, a first pivot point device, a toothbrush holder and a second pivot point device; wherein the shaft is further defined with a first end and a second end; wherein the first pivot point device is mounted to the first end of the shaft and is coupled to the linkage; wherein the second pivot point device is mounted to the second end of the shaft and is coupled to the toothbrush holder.

8. The toothbrush and toothpaste holder a according to claim 1 wherein the first pivot point device rotates the shaft into and out of the plurality of toothbrush storage compartments with respect to a depth of the housing; wherein the open close switch is wired so that when pushed, the motor is activated so that the arm rotates towards the back face.

9. The toothbrush and toothpaste holder according to claim 1 wherein the ultraviolet lights are capable of sanitizing toothbrushes stored in the plurality of toothbrush storage compartments.

* * * * *